US006972272B2

(12) United States Patent
Iwasaki et al.

(10) Patent No.: US 6,972,272 B2
(45) Date of Patent: Dec. 6, 2005

(54) HEAT-SENSITIVE RECORDING MATERIAL

(75) Inventors: Masayuki Iwasaki, Shizuoka-ken (JP); Tsutomu Watanabe, Shizuoka-ken (JP); Hirofumi Mitsuo, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 613 days.

(21) Appl. No.: 10/189,373

(22) Filed: Jul. 3, 2002

(65) Prior Publication Data

US 2003/0087759 A1 May 8, 2003

(30) Foreign Application Priority Data

Jul. 5, 2001 (JP) ..... 2001-204751
Aug. 24, 2001 (JP) ..... 2001-254215

(51) Int. Cl.[7] ..... B41M 5/40
(52) U.S. Cl. ..... 503/216; 503/209; 503/221; 503/226
(58) Field of Search ..... 503/209, 216, 503/221, 226

(56) References Cited

U.S. PATENT DOCUMENTS 4,585,483 A 4/1986 Ikeda et al.

FOREIGN PATENT DOCUMENTS

| | | |
|---|---|---|
| JP | 4-20792 | 4/1992 |
| JP | 4-110188 | 4/1992 |
| JP | 7-314896 | 12/1995 |

OTHER PUBLICATIONS

Japanese Abstract No. 2000247038, date Sep. 12, 2000.

*Primary Examiner*—B. Hamilton Hess
(74) *Attorney, Agent, or Firm*—Sughrue Mion, PLLC

(57) ABSTRACT

A heat-sensitive recording material includes a support having successively disposed thereon: a heat-sensitive color-forming layer containing an electron-donating colorless dye and an electron-accepting compound; and a protective layer; wherein the heat-sensitive color-forming layer contains a water-soluble polymer and 4-hydroxybenzenesulfonanilide as the electron-accepting compound, and the protective layer contains at least one inorganic pigment selected from aluminum hydroxide, kaolin and amorphous silica. The electron-donating colorless dye is preferably at least one selected from 2-anilino-3-methyl-6-di-n-butylaminofluoran, 2-anilino-3-methyl-6-di-n-amylaminofluoran and 2-anilino-3-methyl-6-(N-ethyl-N-p-benzyl)aminofluoran.

20 Claims, No Drawings

HEAT-SENSITIVE RECORDING MATERIAL

BACKGROUND OF THE INVENTION

1. Field of the Invention

The present invention relates to a heat-sensitive recording material. More specifically, it relates to a heat-sensitive recording material that exhibits excellent resistance to inkjet printing ink, has high color density, little likelihood of causing background fogging, excellent image storability, is suitable for inkjet recording, and can suppress abrasion of a thermal head.

2. Description of the Related Art

Heat-sensitive recording materials are widely used because they are relatively inexpensive and capable of being processed in compact recording appliances that are maintenance-free. In order to improve color density and image storability of such heat-sensitive recording materials, research is being extensively conducted with respect to developing electron-donating colorless dyes and electron-accepting compounds and to the layer construction of the heat-sensitive recording materials.

In conventional heat-sensitive recording materials, 2,2-bis(4-hydroxyphenyl)propane (i.e., bisphenol A, or "BPA") has been widely used as an electron-accepting compound for an electron-donating colorless dye. However, satisfactory characteristics, in which equal consideration is given to sensitivity, background fogging and image storability, have not been obtainable.

Japanese Patent Application Publication (JP-B) No. 4-20792 discloses a recording material in which an N-substituted sulfamoylphenol or an N-substituted sulfamoylnaphthol is used as an electron-accepting compound, and describes this (pressure-sensitive and heat-sensitive) recording material as improving image density and image storability and reducing cost. However, there is still room for further improvement in regard to image density and image storability.

Further, when information is recorded as a full-color image on conventional heat-sensitive recording materials, recording is sometimes conducted using inkjet printing ink. When inkjet recording is conducted on an ordinary heat-sensitive recording material, ink colors sometimes are not faithfully reproduced and colors are not vivid, thereby occasionally producing dull colors and blurred images.

In recent years, inkjet printers have become widespread in offices and elsewhere for use in outputting from personal computers, and a situation has arisen in which respective recording surfaces of inkjet recording materials and heat-sensitive recording materials are often disposed facing each other. However, conventional heat-sensitive recording materials are not satisfactorily resistant with respect to ink for inkjet printers. Therefore, when the recording surface of a heat-sensitive recording material contacts the recording surface of an inkjet recording material, there has been the problem of fogging in a background portion and density of an image portion of the heat-sensitive recording material being lowered.

Since images are printed on the heat-sensitive recording material by bringing a thermal head into direct contact with the recording material, it is important to suppress abrasion of the thermal head.

SUMMARY OF THE INVENTION

In view of the aforementioned problems, the present invention has been accomplished. It is an object of the invention to provide a heat-sensitive recording material that exhibits excellent resistance to inkjet printing ink, has high color density, little likelihood of causing background fogging, excellent storability of an image portion, is suitable for inkjet recording, and can suppress abrasion of a thermal head.

A first aspect of the invention is a heat-sensitive recording material comprising a support having successively disposed thereon: a heat-sensitive color-forming layer containing an electron-donating colorless dye and an electron-accepting compound; and a protective layer; wherein the heat-sensitive color-forming layer contains 4-hydroxybenzenesulfonanilide as the electron-accepting compound, and the protective layer contains a water-soluble polymer and at least one inorganic pigment selected from aluminum hydroxide, kaolin and amorphous silica.

In the heat-sensitive recording material according to the first aspect, since the heat-sensitive color-forming layer contains 4-hydroxybenzenesulfonanilide as the electron-accepting compound, and the protective layer contains the water-soluble polymer and at least one inorganic pigment selected from aluminum hydroxide, kaolin and amorphous silica, storability of an image portion (image storability), resistance to inkjet printing ink and suitability for inkjet recording can be improved while suppressing background fogging and maintaining high color density.

A second aspect of the invention is a heat-sensitive recording material comprising a support having succesively disposed thereon: a heat-sensitive color-forming layer containing an electron-donating colorless dye and an electron-accepting compound; and a protective layer; wherein the heat-sensitive color-forming layer contains at least one selected from 2-anilino-3-methyl-6-di-n-butylaminofluoran, 2-anilino-3-methyl-6-di-n-amylaminofluoran and 2-anilino-3-methyl-6-(N-ethyl-N-p-benzyl)aminofluoran as the electron-donating colorless dye and 4-hydroxybenzenesulfonanilide as the electron-accepting compound, and the protective layer contains an inorganic pigment and a water-soluble polymer.

The heat-sensitive recording material according to the invention exhibits resistance to inkjet printing ink, has high color density, little likelihood of causing background fogging, excellent storability of an image portion, improves inkjet recording suitability and suppresses abrasion of a thermal head.

DESCRIPTION OF THE PREFERRED EMBODIMENTS

Description of the heat-sensitive recording material of the present invention is given in detail hereinafter, referring to the heat-sensitive color-forming layer, the protective layer and the support in this order.

Heat-sensitive Color-forming Layer

As described above, the heat-sensitive color-forming layer contains at least an electron-donating colorless dye and an electron-accepting compound, and may further contain, as necessary, a sensitizer, an image stabilizer, an ultraviolet absorbent and a pigment.

Electron-donating Colorless Dye

The heat-sensitive recording material of the present invention is characterized by containing, as the electron-donating colorless dye, at least one selected from 2-anilino-3-methyl-6-di-n-butylaminofluoran, 2-anilino-3-methyl-6-di-n-amylaminofluoran and 2-anilino-3-methyl-6-(N-ethyl-N-p-benzyl)aminofluoran.

Further, in addition to 2-anilino-3-methyl-6-di-n-butylaminofluoran, 2-anilino-3-methyl-6-di-n-amylaminofluoran and 2-anilino-3-methyl-6-(N-ethyl-N-p-benzyl) aminofluoran, other electron-donating colorless dyes may be used in combination, as the electron-donating colorless dye, to an extent that the effects of the invention are not impaired. When other electron-donating colorless dyes are used in combination, the amount of 2-anilino-3-methyl-6-di-n-butylaminofluoran, 2-anilino-3-methyl-6-di-n-amylaminofluoran or 2-anilino-3-methyl-6-(N-ethyl-N-p-benzyl)aminofluoran to be used (the total amount when they are used in combination) is preferably at least 50% by mass, more preferably at least 70% by mass, further preferably at least 90% by mass based on the total mass of electron-donating colorless dyes.

Other examples of the electron-donating colorless dye include 2-anilino-3-methyl-6-N-ethyl-N-sec-butylaminofluoran, 3-(N-isoamyl-N-ethylamino)-6-methyl-7-anilinofluoran, 3-(N-n-hexyl-N-ethylamino)-6-methyl-7-anilinofluoran, 3-[N-(3-ethoxypropyl)-N-ethylamino)-6-methyl-7-anilinofluoran, 3-di(n-butylamino)-7-(2-chloroanilino)fluoran, 3-diethylamino-7-(2-chloroanilino) fluoran, 3-diethylamino-6-methyl-7-anilinofluoran, 3-(N-cyclohexyl-N-methylamino)-6-methyl-7-anilinofluoran, 3-di(n-butylamino)-6-methyl-7-anilinofluoran and 3-di(n-pentylamino)-6-methyl-7-anilinofluoran. In view of background fogging of a non-image portion, 3-di(n-butylamino)-6-methyl-7-anilinofluoran, 2-anilino-3-methyl-6-N-ethyl-N-sec-butylaminofluoran and 3-diethylamino-6-methyl-7-anilinofluoran are preferable.

The coating amount of the electron-donating colorless dye is preferably 0.1 to 1.0 g/m$^2$, more preferably 0.2 to 0.5 g/m$^2$ in view of color density and background fogging density.

Electron-Accepting Compound

The heat-sensitive recording material of the present invention is characterized in that 4-hydroxybenzenesulfonanilide is contained as the electron-accepting compound.

The addition amount of the electron-accepting compound is preferably 50 to 400 parts by mass, more preferably 100 to 300 parts by mass, further preferably 150 to 300 parts by mass, especially preferably 200 to 250 parts by mass relative to 100 parts by mass of the electron-donating colorless dye. When the amount of the electron-accepting compound falls within this range, the effects of the present invention can more efficiently be exhibited.

Further, in addition to 4-hydroxybenzenesulfonanilide, other electron-accepting compounds may be used in combination, as the electron-accepting compound, to an extent that the effects of the invention are not impaired. When other electron-accepting compounds are used in combination, the amount of 4-hydroxybenzenesulfonanilide to be used is preferably at least 50% by mass, more preferably at least 70% by mass, further preferably at least 90% by mass based on the total mass of electron-accepting compounds.

The above-described known electron-donating compounds can suitably be used through selection. In particular, from the standpoint of suppressing background fogging, phenol compounds or salicylic acid derivatives and the polyvalent metal salts thereof are preferable.

Examples of the phenol compound include 2,2'-bis(4-hydroxyphenol)propane (i.e., bisphenol A), 4-t-butylphenol, 4-phenylphenol, 4-hydroxydiphenoxide, 1,1'-bis(4-hydroxyphenyl)cyclohexanone, 1,1'-bis(3-chloro-4-hydroxyphenyl)cyclohexane, 1,1'-bis(3-chloro-4-hydroxyphenyl)-2-ethylbutane, 4,4'-sec-isooctylidenediphenol, 4,4'-sec-butylidenediphenol, 4-tert-octylphenol, 4-p-methylphenylphenol, 4,4'-methylcyclohexylidenephenol, 4,4'-isopentylidenephenol, 4-hydroxy-4-isopropyloxydiphenylsulfone, benzyl p-hydroxybenzoate, 4,4'-dihydroxydiphenylsulfone, 2,4'-dihydroxydiphenylsulfone, 2,4-bis(phenylsulfonyl)phenol and N-(4-hydroxyphenyl)-p-toluenesulfonamide.

Examples of the salicylic acid derivative include 4-pentadecylsalicylic acid, 3,5-di(α-methylbenzyl)salicylic acid, 3,5-di(tert-octyl)salicylic acid, 5-octadecylsalicylic acid, 5-α-(p-α-methylbenzylphenyl)ethylsalicylic acid, 3-α-methylbenzyl-5-tertoctylsalicylic acid, 5-tetradecylsalicylic acid, 4-hexyloxysalicylic acid, 4-cyclohexyloxysalicylic acid, 4-decyloxysalicylic acid, 4-dodecyloxysalicylic acid, 4-pentadecyloxysalicylic acid, 4-octadecyloxysalicylic acid, and the zinc salts, the aluminum salts, the calcium salts, the copper salts and the lead salts thereof.

In the present invention, when preparing a coating solution for the heat-sensitive color-forming layer, the particle size of the electron-accepting compound is preferably 1.0 μm or less, more preferably 0.5 to 0.7 μm in terms of a volume-average particle size. When the volume-average particle size exceeds 1.0 μm, color density might be decreased. The volume-average particle size can easily be measured using a laser diffraction-type particle size distribution measuring device (for example, "LA500", manufactured by Horiba Inc.).

Sensitizer

In the heat-sensitive recording material of the present invention, the heat-sensitive color-forming layer may contain a sensitizer.

The addition amount of the sensitizer is preferably 75 to 300 parts by mass, more preferably 100 to 300 parts by mass, further preferably 150 to 300 parts by mass, especially preferably 200 to 250 parts by mass relative to 100 parts by mass of the electron-donating colorless dye. When the amount of the sensitizer falls within this range, the effect of improving sensitivity is large, and image storability is also improved.

Examples of the sensitizer include 2-benzylnaphthyl ether, 1,2-bis(3-methylphenoxy)ethane, 1,2-diphenoxymethylbenzene, stearic acid amide, aliphatic monoamides, stearylurea, p-benzylbiphenyl, di(2-methylphenoxy)ethane, di(2-methoxyphenoxy)ethane, β-naphthol-(p-methylbenzyl)ether, α-naphthylbenzyl ether, 1,4-butanediol-p-methylphenyl ether, 1,4-butanediol-p-isopropylphenyl ether, 1,4-butanediol-p-tert-octylphenyl ether, 1-phenoxy-2-(4-ethylphenoxy)ethane, 1-phenoxy-2-(chlorophenoxy)ethane, 1,4-butanediolphenyl ether, diethylene glycol bis(4-methoxyphenyl) ether, m-terphenyl, oxalic acid methylbenzyl ether, 1,2-diphenoxymethylbenzene, 1,2-bis(3-methylphenoxy)ethane, 1,4-bis(phenoxymethyl) benzene, 2-benzyloxynaphthalene and ethylene glycol tolyl ether.

Among the above sensitizers, it is preferable to contain at least one selected from 2-benzylnaphthyl ether, 1,2-bis(3-methylphenoxy)ethane and 1,2-diphenoxymethylbenzene. Sensitivity can considerably be improved by containing the sensitizer.

Image Stabilizer and Ultraviolet Absorbent

The heat-sensitive color-forming layer may further contain an image stabilizer and an ultraviolet absorbent.

As the image stabilizer, phenol compounds, in particular, hindered phenol compounds are effective. Examples thereof include 1,1,3-tris(2-methyl-4-hydroxy-5-tert-butylphenyl) butane, 1,1,3-tris(2-ethyl-4-hydroxy-5-cyclohexylphenyl) butane 1,1,3-tris(3,5-di-tert-butyl-4-hydroxyphenyl)butane, 1,1,3-tris(2-methyl-4-hydroxy-5-tert-butylphenyl)propane, 2,2'-methylene-bis(6-tert-butyl-4-methylphenol), 2,2'- methylene-bis(6-tert-butyl-4-ethylphenol), 4,4'-butylidene-bis(6-tert-butyl-3-methylphenol) and 4,4'-thio-bis(3-methyl-6-tert-butylphenol).

The heat-sensitive color-forming layer exhibits improved storability of an image portion by containing the image stabilizer therein.

The addition amount of the image stabilizer is preferably 10 to 100 parts by mass, more preferably 30 to 60 parts by mass relative to 100 parts by mass of the electron-donating colorless dye. When the amount is less than 10 parts by mass, a desired effect on background fogging and image storability cannot be exhibited. When the amount is more than 100 parts by mass, the effects to be obtained is small.

As the ultraviolet absorbent, the following ultraviolet absorbents are listed.

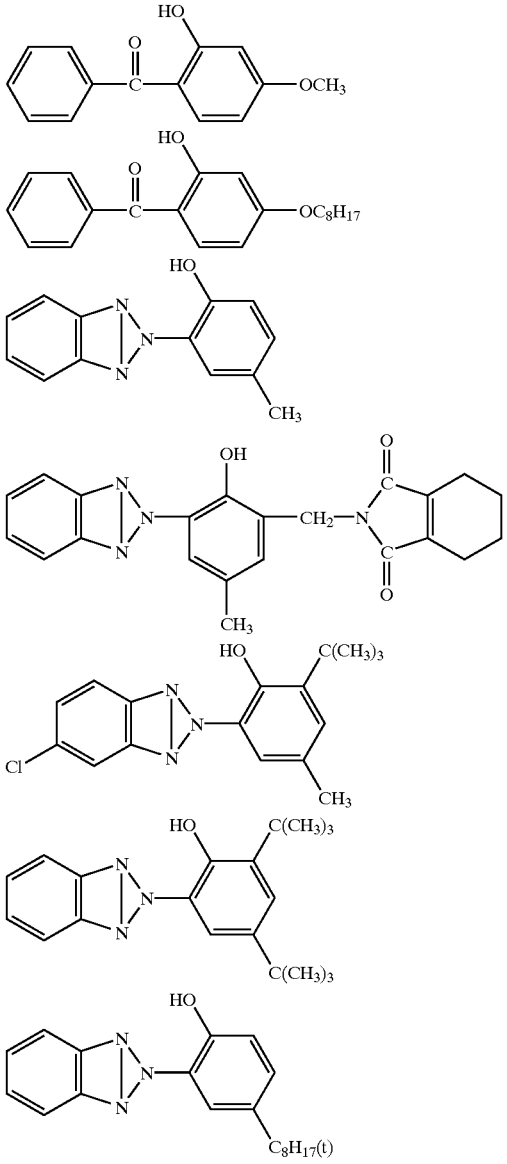

-continued

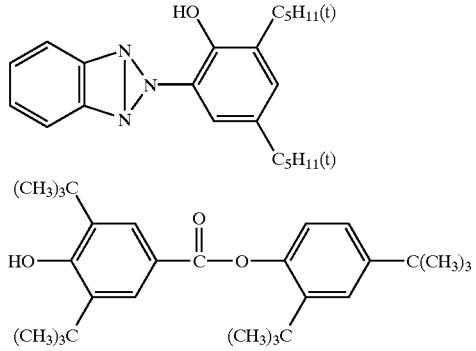

In the present invention, the electron-donating colorless dye, the electron-accepting compound and the sensitizer are dispersed in a water-soluble binder. The water-soluble binder to be used at this point is preferably a compound which is soluble in water held at 25° C. in an amount of at least 5% by mass.

Specific examples of the water-soluble binder include polyvinyl alcohol, methylcellulose, carboxymethylcellulose, starches (including modified starches), gelatins, gum arabic, casein and a saponified product of a styrene/maleic anhydride copolymer.

These binders are used not only for dispersing the compounds but also for improving film strength of the heat-sensitive color-forming layer. For this purpose, synthetic polymer latex-type binders such as a styrene/butadiene copolymer, a vinyl acetate copolymer, an acrylonitrile/butadiene copolymer, a methyl acrylate/butadiene copolymer or polyvinylidene chloride can also be used in combination.

The electron-donating colorless dye, the electron-accepting compound and the sensitizer may be dispersed using a stirrer or a pulverizer such as a ball mill, an attritor or a sand mill either simultaneously or separately to prepare a coating solution. The coating solution may further contain, as necessary, a variety of pigments, metallic soaps, waxes, surfactants, antistatic agents, defoamers and fluorescent dyes.

As the pigment, calcium carbonate, barium sulfate, lithopone, agalmatolite, kaolin, calcined kaolin, amorphous silica and aluminum hydroxide are used. Among these, basic pigments such as calcium carbonate and aluminum hydroxide are preferably used in order to obtain a heat-sensitive recording material having little likelihood of background fogging.

As the metallic soap, higher fatty acid metal salts are used. For example, zinc stearate, calcium stearate and aluminum stearate may be used.

As the wax, paraffin wax, microcrystalline wax, carnauba wax, methylolstearamide wax, polyethylene wax, polystyrene wax and fatty acid amide waxes are used either singly or in combination. As the surfactant, the alkali metal salts or the ammonium salts of an alkylbenzenesulfonic acid, the alkali metal salts of sulfosuccinic acids and fluorine-containing surfactants are used.

These components are mixed, and the resultant mixture is then coated on the support. The coating method is not particularly limited. For example, the mixture is coated using an air knife coater, a roll coater, a blade coater or a curtain coater, and then the coating is dried and smoothed with a calender to be actually used. In particular, a curtain coater is preferably used in the present invention.

The coating amount of the heat-sensitive color-forming layer is not particularly limited. Preferably, the amount is approximately 2 to 7 g/m$^2$ in terms of a dry mass.

Protective Layer

A protective layer containing an inorganic pigment and a water-soluble polymer is provided on the heat-sensitive color-forming layer. The protective layer can further contain a surfactant and a thermally fusible substance. Further, another layer may be provided between the heat-sensitive color-forming layer and the protective layer.

The coating amount of the protective layer after dried is preferably 0.5 to 2.5 g/m$^2$. When the coating amount of the protective layer after dried falls within this range, abrasion of a thermal head can be suppressed while maintaining high color density.

Examples of the inorganic pigment include calcium carbonate, colloidal silica, amorphous silica, zinc oxide, titanium oxide, aluminum hydroxide, zinc hydroxide, barium sulfate, zinc sulfate, clay, talc, kaolin and surface-treated calcium or silica. It is preferable to contain at least one selected from aluminum hydroxide, kaolin and amorphous silica.

The volume-average particle size of the inorganic pigment is preferably 0.5 to 0.9 $\mu$m, more preferably 0.6 to 0.8 $\mu$m. In the protective layer, from the standpoint of improving image storability, it is preferable to use as the inorganic pigment aluminum oxide having a volume-average particle size of 0.5 to 0.9 $\mu$m. Further, from the standpoint of improving suitability for inkjet recording, it is preferable to use amorphous silica.

The amount of the inorganic pigment to be added is preferably 10 to 90% by mass, more preferably 30 to 70% by mass based on the solid content of a coating solution for a protective layer. Further, barium sulfate, zinc sulfate, talc, clay and colloidal silica may be used in combination with the inorganic pigment to an extent that the effects of the invention are not impaired.

The mixing ratio of the inorganic pigment and the water-soluble polymer in the protective layer varies depending on the type and the particle size of the inorganic pigment used and the type of the water-soluble polymer used. The water-soluble polymer is added in a ratio preferably 50 to 400% by mass, more preferably 100 to 250% by mass based on the inorganic pigment.

The total amount of the inorganic pigment and the water-soluble polymer contained in the protective layer is preferably 50% or more by mass based on the protective layer.

Examples of the water-soluble polymer contained in the protective layer for use in the present invention include polyvinyl alcohol or modified polyvinyl alcohol (hereinafter referred to generally as "polyvinyl alcohol"), starch or modified starch such as oxidized starch and urea phosphated starch, and carboxyl group-containing polymers such as styrene/maleic anhydride copolymer, styrene/maleic anhydride copolymer alkyl ester and styrene/acrylic acid copolymer. Among these, polyvinyl alcohol, oxidized starch and urea phosphated starch are preferable, and it is especially preferable that polyvinyl alcohol (x) and oxidized starch and/or urea phosphated starch (y) are mixed in a mass ratio (x/y) of 90/10 to 10/90. When these three are used in combination, it is more preferable that oxidized starch and urea phosphated starch are used in a mass ratio of 10/90 to 90/10.

As the modified polyvinyl alcohol, acetoacetyl-modified polyvinyl alcohol, diacetone-modified polyvinyl alcohol, silicon-modified polyvinyl alcohol and amide-modified polyvinyl alcohol are preferably used. In addition, sulfo-modified polyvinyl alcohol and carboxy-modified polyvinyl alcohol are used. When these polyvinyl alcohols are used in combination with a crosslinking agent which is reactive therewith, better results are obtained.

The amount of the water-soluble polymer to be added is preferably 10 to 90% by mass, more preferably 30 to 70% by mass based on the solid content of a coating solution for a protective layer.

Preferable examples of the crosslinking agent for crosslinking the water-soluble polymer include polyvalent amine compounds such as ethylenediamine, polyvalent aldehyde compounds such as glyoxal, glutaraldehyde and dialdehyde, dihydrazide compounds such as adipic acid dihydrazide and phthalic acid dihydrazide, water-soluble methylol compounds (urea, melamine and phenol), polyfunctional epoxy compounds and polyvalent metal salts (Al, Ti, Zr, Mg and the like). The amount of the crosslinking agent to be added is preferably 2 to 30% by mass, more preferably 5 to 20% by mass based on polyvinyl alcohol. Use of the crosslinking agent improves film strength and water resistance. As the crosslinking agent used in the invention, polyvalent aldehyde compounds and dihydrazide compounds are preferable.

Further, if a surfactant is added to a coating solution for a protective layer, suitability for inkjet printing ink is obtained. Preferable examples of the surfactant include alkylbenzenesulfonates such as sodium dodecylbenzenesulfonate, alkylsulfosuccinates such as sodium dioctylsulfosuccinate, polyoxyethylenealkyl ether phosphates, sodium hexametaphosphate and perfluoroalkyl carboxylates. Among these, alkylsulfosuccinates are more preferable. The amount of the surfactant to be added is preferably 0.1 to 5% by mass, more preferably 0.5 to 3% by mass based on the solid content of a coating solution for a protective layer.

The coating solution for the protective layer can further contain a lubricant, a defoamer, a fluorescent brightener and an organic colored pigment to an extent that the effects of the invention are not impaired. Examples of the lubricant include metallic soaps such as zinc stearate and calcium stearate, waxes such as paraffin wax, microcrystalline wax, carnauba wax and synthetic polymer wax.

Mordant

In the heat-sensitive recording material of the invention, it is effective to include a mordant for providing suitability for inkjet recording. In particular, use of the mordant inhibits bleeding caused by inkjet recording. The mordant may be added to either the heat-sensitive recording layer or the protective layer. It is preferable, however, that the mordant is incorporated into the protective layer provided on the uppermost surface of the heat-sensitive recording material. As the mordant, cationic polymers which act as a mordant of inkjet printing ink are preferable. The cationic polymer is a polymer containing a cationic group such as an amide group, an imide group, a primary amino group, a secondary amino group, a tertiary amino group, a primary ammonium salt group, a secondary ammonium salt group, a tertiary ammonium salt group or a quaternary ammonium salt group. Examples of the cationic polymer include polyethylenimine, polydiallylamine, polyallylamine, polydiallyldimethylammonium chloride, polymethacryloyloxyethyl-β-hydroxyethyldimethylammonium chloride, polyallylamine hydrochloride, a polyamide-polyamine resin, cationized starch, a dicyandiamide formalin condensate, a dimethyl-2-hydroxypropylammonium salt polymer, polyamidine, polyvinylamine, polyvinylbenzyltrimethylammonium chloride, polydimethylaminoethyl methacrylate hydrochloride and polyaminepolyamyl epichlorohydrin. The molecular weight of these mordants is preferably 1,000 to 200,000. When the molecular weight is less than 1,000, water resistance tends to be unsatisfactory. When it exceeds 200,000, viscosity is increased, and handling properties may become worse.

Support

As the support for use in the invention, conventionally known supports may be used. Specific examples thereof include supports made of paper, such as woodfree paper, paper having a resin or a pigment thereon, resin-laminated paper, woodfree paper having an undercoat layer, synthetic paper, and plastic films.

As the support, a smooth support exhibiting smoothness of at least 300 seconds measured according to JIS-P 8119 is preferable in view of dot reproducibility. As will be described layer, the heat-sensitive recording surface of the heat-sensitive recording material of the present invention is preferably a smooth surface exhibiting Oken type smoothness of at least 300 seconds. In order to provide a smooth surface exhibiting Oken type smoothness of at least 300 seconds, the heat-sensitive recording surface preferably has smoothness measured according to JIS-P 8119 of at least 100 seconds. Further, for providing a smooth surface exhibiting smoothness of at least 500 seconds, smoothness measured according to JIS-P 8119 is preferably at least 200 seconds, and for providing a smooth surface exhibiting smoothness of at least 700 seconds, smoothness measured according to JIS-P 8119 is preferably at least 300 seconds.

If an undercoat layer is provided on the support, it is preferable to form an undercoat layer which contains a pigment as the main component. As the pigment, all of ordinary inorganic and organic pigments may be used. In particular, a pigment having an oil absorption value of at least 40 ml/100 g (cc/100 g) measured according to JIS-K 5101 is preferable. Specific examples thereof include calcium carbonate, barium sulfate, aluminum hydroxide, kaolin, calcined kaolin, amorphous silica and a urea formalin resin powder. Among these, calcined kaolin having an oil absorption value of 70 ml/100 g or more is particularly preferable.

The coating amount of the undercoat layer after dried is at least 2 g/m$^2$, preferably at least 4 g/m$^2$, more preferably 7 to 12 g/m$^2$ in terms of a weight after drying.

Examples of the binder to be used in the undercoat layer include water-soluble polymers and aqueous binders. These may be used either singly or in combination of two or more.

Examples of the water-soluble polymer include starch, polyvinyl alcohol, polyacrylamide, carboxymethyl alcohol, methylcellulose and casein.

The aqueous binders to be used are usually synthetic rubber latexes and synthetic resin emulsions. Examples thereof include a styrene-butadiene rubber latex, an acrylonitrile-butadiene rubber latex, a methyl acrylate-butadiene rubber latex and a vinyl acetate emulsion.

The amount of these binders to be added is 3 to 100% by mass, preferably 5 to 50% by mass, more preferably 8 to 15% by mass based on the pigment used in the undercoat layer. The undercoat layer may further contain a wax, an anti-fading agent and a surfactant.

The undercoat layer can be applied by known coating methods. Specifically, methods using an air knife coater, a roll coater, a blade coater, a gravure coater or a curtain coater may be employed. Among these, the method using a blade coater is preferable. Further, smoothing treatment using a calender may be applied as necessary.

EXAMPLES

The present invention is illustrated specifically by referring to the following Examples, but it is to be understood that the invention is not limited to these Examples. In the Examples, "parts or part" and "%" are "parts or part by mass" and "% by mass" unless otherwise indicated.

Example 1

(Preparation of a Coating Solution for a Heat-sensitive Color-forming Layer)

<Preparation of Solution A (Containing an Electron-donating Colorless Dye)>

A dispersion containing particles having an average particle size of 0.8 μm was prepared using a ball mill according to the following formulation.

| [Formulation of solution A] | |
|---|---|
| 2-anilino-3-methyl-6-di-n-butylaminofluoran | 10 parts |
| a 2.5% solution of polyvinyl alcohol (PVA-105, manufactured by Kuraray, degree of saponification 98.5 mol %, degree of polymerization 500) | 50 parts |

<Preparation of Solution B (Containing an Electron-accepting Compound)>

A dispersion containing particles having an average particle size of 0.8 μm was prepared using a ball mill according to the following formulation.

| [Formulation of solution B] | |
|---|---|
| 4-hydroxybenzenesufonanilide | 20 parts |
| a 2.5% solution of polyvinyl alcohol (PVA-105) | 100 parts |

<Preparation of Solution C (Containing a Sensitizer)>

A dispersion containing particles having an average particle size of 0.8 μm was prepared using a ball mill according to the following formulation.

| [Formulation of solution C] | |
|---|---|
| 2-benzyloxynaphthalene | 20 parts |
| a 2.5% solution of polyvinyl alcohol (PVA-105) | 100 parts |

<Preparation of Solution D (Containing a Pigment)>

A dispersion of the pigment having an average particle size of 2.0 μm was prepared using a sand mill according to the following formulation.

| [Formulation of solution D] | |
|---|---|
| calcium carbonate | 40 parts |
| sodium polyacrylate | 1 part |
| water | 60 parts |

<Coating Solution for a Heat-sensitive Color-forming Layer>

Sixty parts of solution A, 120 parts of solution B, 120 parts of solution C, 101 parts of solution D, 15 parts of a 30% dispersion of zinc stearate, 15 parts of a paraffin wax solution (30% dispersion) and 4 parts of sodium dodecylbenzenesulfonate (25%) were admixed to prepare a coating solution for a heat-sensitive color-forming layer.

<Preparation of a Coating Solution for a Protective Layer>

The following components were dispersed using a sand mill to prepare a dispersion of the pigment having an average particle size of 2 μm.

| | |
|---|---|
| calcium carbonate | 40 parts |
| sodium polyacrylate | 1 part |
| water | 60 parts |

Sixty parts of water was added to 240 parts of a 25% aqueous solution of styrene/maleic anhydride copolymer alkyl ester (POLYMARON 385, manufactured by Arakawa Chemical Inc.), and the resulting solution was mixed with the above described dispersion of the pigment and further with 25 parts of an emulsified dispersion of zinc stearate (HIDORIN F115, manufactured by Chukyo Yushi Co., Ltd.) having an average particle size of 0.15 μm and 125 parts of a 2% aqueous solution of sodium 2-ethylhexylsulfosuccinate to prepare a coating solution for a protective layer.

<Preparation of a Coating Solution for an Undercoat Layer>

The following components were admixed using a dissolver with stirring, followed by addition of 20 parts of SBR (styrene-butadiene latex) and 25 parts of oxidized starch (25%) to prepare a coating solution for an undercoat layer to be applied on a support.

| <Formulation of a coating solution for an undercoat layer> | |
|---|---|
| calcined kaolin (oil absorption value of 75 ml/100 g) | 100 parts |
| sodium hexametaphosphate | 1 part |
| water | 110 parts |

<Production of a Heat-sensitive Recording Material>

The coating solution for an undercoat layer to be applied on a support was applied onto woodfree base paper to provide a weight of 50 g/m$^2$ using a blade coater such that a coating amount after dried reached 8 g/m$^2$. After the layer was dried, calender treatment was conducted to produce undercoated paper. Then, the coating solution containing the heat-sensitive recording material was coated on the undercoat layer using a curtain coater such that a coating amount after dried reached 4 g/m$^2$. Further, the coating solution for the protective layer was applied onto the heat-sensitive color-forming layer using a curtain coater such that a coating amount after dried reached 2 g/m$^2$, and then dried. The surface of the resulting protective layer was subjected to calender treatment to obtain a heat-sensitive recording material of Example 1.

Example 2

A heat-sensitive recording material of Example 2 was obtained in the same manner as in Example 1 except that calcium carbonate used in the protective layer of Example 1 was replaced with aluminum hydroxide (HIGILITE H42, manufactured by Showa Denko) having an average particle size of 1 μm.

Example 3

A heat-sensitive recording material of Example 3 was obtained in the same manner as in Example 1 except that calcium carbonate used in the protective layer of Example 1 was replaced with kaolin (KAOBRIGHT, manufactured by Shiraishi Kogyo Corp.) having an average particle size of 2 μm.

Example 4

A heat-sensitive recording material of Example 4 was obtained in the same manner as in Example 2 except that 240 parts of a 25% aqueous solution of styrene/maleic anhydride copolymer alkyl ester (POLYMARON 385, manufactured by Arakawa Chemical Inc.) was replaced with 400 parts of a 15% aqueous solution of polyvinyl alcohol (PVA-105, manufactured by Kuraray).

Example 5

A heat-sensitive recording material of Example 5 was obtained in the same manner as in Example 2 except that 240 parts of a 25% aqueous solution of styrene/maleic anhydride copolymer alkyl ester (POLYMARON 385, manufactured by Arakawa Chemical Inc.) was replaced with 400 parts of a 15% aqueous solution of oxidized starch (MS3800, manufactured by Nihon Shokuhin Kako Co., Ltd.).

Example 6

A heat-sensitive recording material of Example 6 was obtained in the same manner as in Example 2 except that 240 parts of a 25% aqueous solution of styrene/maleic anhydride copolymer alkyl ester (POLYMARON 385, manufactured by Arakawa Chemical Inc.) was replaced with 400 parts of a 15% aqueous solution of urea phosphated starch (MS4600, manufactured by Nihon Shokuhin Kako Co., Ltd.).

Example 7

A heat-sensitive recording material of Example 7 was obtained in the same manner as in Example 2 except that 240 parts of a 25% aqueous solution of styrene/maleic anhydride copolymer alkyl ester (POLYMARON 385, manufactured by Arakawa Chemical Inc.) was replaced with 200 parts of a 15% aqueous solution of oxidized starch (MS3800, manufactured by Nihon Shokuhin Kako Co., Ltd.) and 200 parts of a 15% aqueous solution of polyvinyl alcohol (PVA-105, manufactured by Kuraray).

Example 8

A heat-sensitive recording material of Example 8 was obtained in the same manner as in Example 2 except that 240 parts of a 25% aqueous solution of styrene/maleic anhydride copolymer alkyl ester (POLYMARON 385, manufactured by Arakawa Chemical Inc.) was replaced with 200 parts of a 15% aqueous solution of urea phosphated starch (MS4600, manufactured by Nihon Shokuhin Kako Co., Ltd.) and 200 parts of a 15% aqueous solution of polyvinyl alcohol (PVA-105, manufactured by Kuraray).

Example 9

A heat-sensitive recording material of Example 9 was obtained in the same manner as in Example 7 except that aluminum hydroxide having the average particle size of 1 μm used in Example 7 was replaced with aluminum hydroxide (C-3005, manufactured by Sumitomo Chemical) having an average particle size of 0.6 μm.

Example 10

A heat-sensitive recording material of Example 10 was obtained in the same manner as in Example 9 except that 200 parts of the 15% aqueous solution of polyvinyl alcohol (PVA-105, manufactured by Kuraray) used in Example 9 was replaced with 400 parts of a 7.5% aqueous solution of silicon-modified polyvinyl alcohol (R-1130, manufactured by Kuraray).

Example 11

A heat-sensitive recording material of Example 11 was obtained in the same manner as in Example 9 except that 200 parts of the 15% aqueous solution of polyvinyl alcohol (PVA-105, manufactured by Kuraray) used in Example 9 was replaced with 400 parts of a 7.5% aqueous solution of diacetone-modified polyvinyl alcohol (D-700, manufactured by Unitika Ltd.) and to the resultant mixture was added 30 parts of a 5% aqueous solution of adipic acid dihydrazide.

Example 12

A heat-sensitive recording material of Example 12 was obtained in the same manner as in Example 9 except that 200 parts of the 15% aqueous solution of polyvinyl alcohol (PVA-105, manufactured by Kuraray) used in Example 9 was replaced with 400 parts of a 7.5% aqueous solution of acetoacetyl-modified polyvinyl alcohol (GOHSEFIMER Z-200, manufactured by The Nippon Synthetic Chemical Industry Co., Ltd.) and to the resultant mixture was added 30 parts of a 10% aqueous solution of glyoxal.

Example 13

A heat-sensitive recording material of Example 13 was obtained in the same manner as in Example 9 except that 200 parts of the 15% aqueous solution of polyvinyl alcohol (PVA-105, manufactured by Kuraray) used in Example 9 was replaced with 400 parts of a 7.5% aqueous solution of amide-modified polyvinyl alcohol (NP20H, manufactured by The Nippon Synthetic Chemical) and to the resultant mixture was added 30 parts of a 10% aqueous solution of glyoxal.

Example 14

A heat-sensitive recording material of Example 14 was obtained in the same manner as in Example 10 except that the coating solution for the heat-sensitive layer used in Example 10 was applied using an air knife coater.

Example 15

A heat-sensitive recording material of Example 15 was obtained in the same manner as in Example 13 except that aluminum oxide used in the coating solution for the protective layer of Example 13 was replaced with amorphous silica (MIZUKASIL P-78A, manufactured by Mizusawa Chemical).

Example 16

A heat-sensitive recording material of Example 16 was obtained in the same manner as in Example 15 except that 40 parts of polyaminepolyamyl epichlorohydrin (ARAFIX 300, manufactured by Arakawa Chemical Inc.) was added to the coating solution for the protective layer of Example 15.

Comparative Example 1

A heat-sensitive recording material of Comparative Example 1 was obtained in the same manner as in Example 1 except that 4-hydroxybenzenesulfonanilide used to prepare solution B of Example 1 was replaced with bisphenol A.

Comparative Example 2

A heat-sensitive recording material of Comparative Example 2 was obtained in the same manner as in Example 1 except that the coating solution for the protective layer of Example 1 was not applied.

Comparative Example 3

A heat-sensitive recording material of Comparative Example 3 was obtained in the same manner as in Example 1 except that calcium carbonate used in the protective layer of Example 1 was replaced with rutile titanium oxide (TIPAQUE W107, manufactured by Ishihara Sangyo).

Evaluation

The heat-sensitive recording materials obtained in Examples 1 to 16 and Comparative Examples 1 to 3 were evaluated, and the results of the evaluation are shown in Table 1 below. Sensitivity, background fogging, image storability, inkjet printing ink resistance and abrasion of a thermal head were evaluated as follows.

Sensitivity

Printing-was conducted using a heat-sensitive printing system having a thermal head (KJT-216-8 MPD1, manufactured by Kyocera Corp.), with applying a pressure of 100 kg/cm$^2$ at a site just before the head, under the conditions of a head voltage of 24 V, a pulse period of 10 ms and a pulse width of 1.5 ms, and printing density was measured using Macbeth reflection densitometer RD-918. The higher the value indicated, the better the sensitivity obtained.

Background Fogging

The heat-sensitive recording materials were allowed to stand at 60° C. for 24 hours and then measured for background fogging by using Macbeth RD-918. The lower the value shown, the less occurrence of background fogging, and thereby preferable.

Image Storability

After image formation and kept standing at 60° C. for 24 hours, image density was measured using Macbeth RD-918, and a residual ratio of image density to an untreated material was calculated. The higher the value indicated, the better the image storability obtained.

Inkjet Printing Ink Resistance

A high-quality image obtained by using an inkjet printer (MJ930C, manufactured by Seiko Epson K. K.) was brought into contact with a heat-sensitive recording surface of a heat-sensitive recording material printed as carried out in the above section (Sensitivity) and allowed to stand at 25° C. for 48 hours. Then, image density was measured using Macbeth RD-918. Further, image density of an untreated material was also measured, and a ratio (residual ratio) of image density of the treated material to image density of the untreated material was calculated. The higher the value indicated, the better the inkjet printing ink resistance achieved.

Abrasion of Thermal Head

Images were printed on one thousand A4-size sheets using a word processor (RUPO JV, manufactured by Toshiba Corporation) and a test chart having a printing rate of 20%. Then, an abrasion level of a serial thermal head was observed, and evaluated according to the following criteria. The results are shown in Table 1.

Criteria

○: Almost no abrasion of the thermal head was observed, nor were there any portions in the prints where the paper showed through due to thermal head abrasion.

Δ: Abrasion was slightly observed on the thermal head, but there were not any portions in the prints where the paper showed through due to thermal head abrasion.

x: Abrasion of the thermal head was significant, and there were portions in the prints where the paper showed through due to thermal head abrasion.

Evaluation of Suitability for Inkjet Recording

Red-colored characters were printed on each of the heat-sensitive recording materials in a superfine mode using an inkjet printer (MJ930, manufactured by Seiko Epson K. K.), and bleeding was evaluated.

Bleeding

◎: Characters were clearly legible.

○: Some bleeding of characters occurred, but characters still legible.

Δ: Characters bled and were difficult to read, but still decipherable.

x: Characters bled and were completely indecipherable.

TABLE 1

| | Sensitivity | Background Fogging | Image Storability | Inkjet Printing Ink Resistance | Abrasion of Thermal Head | Suitability for Inkjet Recording |
|---|---|---|---|---|---|---|
| Ex. 1 | 1.21 | 0.10 | 93% | 90% | ○ | ○ |
| Ex. 2 | 1.23 | 0.09 | 95% | 92% | ○ | ○ |
| Ex. 3 | 1.24 | 0.10 | 96% | 94% | ○ | ○ |
| Ex. 4 | 1.23 | 0.09 | 95% | 95% | ○ | ○ |
| Ex. 5 | 1.21 | 0.09 | 96% | 97% | ○ | ○ |
| Ex. 6 | 1.21 | 0.09 | 95% | 96% | ○ | ○ |
| Ex. 7 | 1.23 | 0.09 | 93% | 97% | ○ | ○ |
| Ex. 8 | 1.23 | 0.09 | 95% | 97% | ○ | ○ |
| Ex. 9 | 1.24 | 0.09 | 96% | 98% | ○ | ○ |
| Ex. 10 | 1.27 | 0.09 | 98% | 99% | ○ | ○ |
| Ex. 11 | 1.24 | 0.08 | 96% | 99% | ○ | ○ |
| Ex. 12 | 1.24 | 0.09 | 98% | 99% | ○ | ○ |
| Ex. 13 | 1.24 | 0.09 | 99% | 99% | ○ | ○ |
| Ex. 14 | 1.23 | 0.09 | 96% | 96% | ○ | ○ |
| Ex. 15 | 1.22 | 0.09 | 99% | 99% | ○ | ◎ |
| Ex. 16 | 1.20 | 0.09 | 99% | 99% | ○ | ◎ |
| Comp. Ex. 1 | 1.20 | 0.10 | 80% | 80% | ○ | ○ |
| Comp. Ex. 2 | 1.30 | 0.09 | 85% | 81% | Δ | Δ |
| Comp. Ex. 3 | 1.20 | 0.11 | 90% | 88% | X | ○ |

As is apparent from Table 1, in the heat-sensitive recording materials in which 4-hydroxybenzenesulfonanilide was used as the electron-accepting compound and further the protective layer containing the inorganic pigment and the water-soluble polymer was provided, sensitivity was good, there was little background fogging, and image storability, inkjet printing ink resistance and suitability for inkjet recording were excellent, and less abrasion of the thermal head observed.

Meanwhile, in the heat-sensitive recording material obtained in Comparative Example 1 in which the same protective layer was provided but bisphenol A was used as the electron-accepting compound, inkjet printing ink resistance, background fogging and image storability were poor. Further, in the heat-sensitive recording material (obtained in Comparative Example 2) in which the electron-accepting compound of the invention was used but the protective layer was not provided, sensitivity was good and there was little background fogging, but image storability and inkjet printing ink resistance were poor.

Example 17

A heat-sensitive recording material of Example 17 was produced in the same manner as in Example 1 except that 2-anilino-3-methyl-6-di-n-butylaminofluoran used in the formulation of solution A in Example 1 was replaced with 2-anilino-3-methyl-6-di-n-amylaminofluoran.

Example 18

A heat-sensitive recording material of Example 18 was produced in the same manner as in Example 1 except that 2-anilino-3-methyl-6-di-n-butylaminofluoran used in the formulation of solution A in Example 1 was replaced with 2-anilino-3-methyl-6-(N-ethyl-N-p-benzyl)aminofluoran.

Example 19

A heat-sensitive recording material of Example 19 was produced in the same manner as in Example 1 except that the coating amount of the protective layer in Example 1 was changed from 2 g/m$^2$ to 0.5 g/m$^2$.

Example 20

A heat-sensitive recording material of Example 20 was produced in the same manner as in Example 1 except that the coating amount of the protective layer in Example 1 was changed from 2 g/m$^2$ to 1.0 g/m$^2$.

Example 21

A heat-sensitive recording material of Example 21 was produced in the same manner as in Example 1 except that the coating amount of the protective layer in Example 1 was changed from 2 g/m$^2$ to 2.5 g/m$^2$.

Comparative Example 4

A heat-sensitive recording material of Comparative Example 4 was produced in the same manner as in Example 1 except that 4-hydroxybenzenesulfonanilide used in the formulation of solution B in Example 1 was replaced with bisphenol A.

Comparative Example 5

A heat-sensitive recording material of Comparative Example 5 was produced in the same manner as in Example 1 except that 4-hydroxybenzenesulfonanilide used in the formulation of solution B in Example 1 was replaced with N-benzyl-4-hydroxybenzenesulfonamide.

Comparative Example 6

A heat-sensitive recording material of Comparative Example 6 was produced in the same manner as in Example 1 except that 2-anilino-3-methyl-6-di-n-butylaminofluoran used in the formulation of solution A in Example 1 was replaced with 2-anilino-3-methyl-6-di-n-ethylaminofluoran.

Comparative Example 7

A heat-sensitive recording material of Comparative Example 7 was produced in the same manner as in Example 1 except that 2-anilino-3-methyl-6-di-n-butylaminofluoran used in the formulation of solution A in Example 1 was replaced with 3-dimethylamino-6-methyl-7-(m-toluidino) fluoran.

Comparative Example 8

A heat-sensitive recording material of Comparative Example 8 was produced in the same manner as in Example 1 except that the protective layer in Example 1 was not provided.

Evaluation

The heat-sensitive recording materials obtained in Examples 1 and 17 to 21 and Comparative Examples 4 to 8 were evaluated and the results of the evaluation are shown in Table 2 below. Sensitivity, background fogging, image storability, inkjet printing suitability and abrasion of a thermal head were evaluated as follows.

Sensitivity

Printing was conducted using a heat-sensitive printing system having a thermal head (KJT-216-8MPD1, manufactured by Kyocera Corp.), with applying a pressure of 100 kg/cm$^2$ just before the head, under the conditions of a head voltage of 24 V, a pulse period of 10 ms and a pulse width of 1.5 ms, and printing density was measured using Macbeth reflection densitometer RD-918. The higher the value indicated, the better the sensitivity obtained, and thereby preferable.

Background Fogging

The heat-sensitive recording materials were allowed to stand at 60° C. for 24 hours and then assessed for background fogging using Macbeth RD-918. The lower the value shown, the less occurrence of background fogging, and thereby preferable.

Image Storability

Images were recorded on each of the heat-sensitive recording materials using the above described printer under the aforementioned conditions. Immediately after the printing, image density was measured using Macbeth reflection densitometer (RD-918). Then, the materials were allowed to stand in an atmosphere of 60° C. and relative humidity of 20% for 24 hours, and image density after kept standing was measured using Macbeth reflection densitometer (RD-918). A ratio (image storability ratio) of image density after kept standing to image density immediately after printing was calculated. The higher the value shown, the better the image storability achieved.

Image storability ratio=(image density after kept standing under the above-described conditions)/(image density immediately after printing)×100

Suitability for Inkjet Printing

Red colored characters were printed on each of the heat-sensitive recording materials in a superfine mode using an inkjet printer (MJ930, manufactured by Seiko Epson K. K.), and the color (fogging) of the characters was evaluated.

Criteria

○: vivid

Δ: dull x: close to black than red

Abrasion of Thermal Head

Images were printed on one thousand A4-size sheets using a word processor (RUPO JV, manufactured by Toshiba Corporation) and a test chart having a printing rate of 20%. Then, an abrasion level of a serial thermal head was observed, and evaluated according to the following criteria. The results are shown in Table 2 below.

Criteria

○: Almost no abrasion of the thermal head was observed, nor were there any portions in the prints where the paper showed through due to thermal head abrasion.

Δ: Abrasion was slightly observed on the thermal head, but there were not any portions in the prints where the paper showed through due to thermal head abrasion.

x: Abrasion of the thermal head was significant, and there were portions in the prints where the paper showed through due to thermal head abrasion.

TABLE 2

| | Sensitivity | Background Fogging | Image Storability Ratio (%) | Inkjet Fogging | Abrasion of Thermal Head |
|---|---|---|---|---|---|
| Ex. 1 | 1.29 | 0.06 | 98 | ○ | ○ |
| Ex. 17 | 1.30 | 0.06 | 100 | ○ | ○ |
| Ex. 18 | 1.27 | 0.06 | 97 | ○ | ○ |
| Ex. 19 | 1.31 | 0.06 | 95 | ○ | ○ |
| Ex. 20 | 1.30 | 0.06 | 96 | ○ | ○ |
| Ex. 21 | 1.25 | 0.06 | 100 | ○ | ○ |
| Comp. Ex. 4 | 1.21 | 0.07 | 70 | X | ○ |
| Comp. Ex. 5 | 1.14 | 0.10 | 60 | X | ○ |
| Comp. Ex. 6 | 1.16 | 0.10 | 92 | ○ | ○ |
| Comp. Ex. 7 | 1.13 | 0.12 | 91 | ○ | ○ |
| Comp. Ex. 8 | 1.32 | 0.06 | 90 | ○ | Δ |

As is apparent from Table 2, in the heat-sensitive recording materials obtained in Examples 1 and 17-21 of the present invention, sensitivity was excellent, there was little background fogging, and image storability, suitability for inkjet recording (fogging) and thermal head suitability (abrasion) were good. Meanwhile, in the heat-sensitive recording material obtained in Comparative Example 4 in which bisphenol A was used as the electron-accepting compound, sensitivity, image storability and inkjet fogging were unsatisfactory. And in the heat-sensitive recording material obtained in Comparative Example 5 in which N-benzyl-4-hydroxybenzenesulfonamide was used as the electron-accepting compound, sensitivity, image storability and inkjet fogging were unsatisfactory. In the heat-sensitive recording material obtained in Comparative Example 6 in which 2-anilino-3-methyl-6-n-diethylaminofluoran was used as the electron-donating colorless dye and in the heat-sensitive recording material in Comparative Example 7 in which 3-dimethylamino-6-methyl-7-(m-toluidino)fluoran was used as the electron-donating colorless dye, sensitivity was unsatisfactory. In the heat-sensitive recording material obtained in Comparative Example 8 in which the protective layer was not provided, slight abrasion was observed on the thermal head and thermal head adaptability was unsatisfactory.

According to the present invention, there is provided a heat-sensitive recording material having inkjet printing ink resistance, high color density, little likelihood of causing background fogging, excellent image storability of an image portion, suitability for inkjet recording and less abrasion of the thermal head.

What is claimed is:

1. A heat-sensitive recording material comprising a support having successively disposed thereon:

a heat-sensitive color-forming layer containing an electron-donating colorless dye and an electron-accepting compound; and a protective layer;

wherein the heat-sensitive color-forming layer contains 4-hydroxybenzenesulfonanilide as the electron-accepting compound, and the protective layer contains a water-soluble polymer and at least one inorganic pigment selected from aluminum hydroxide, kaolin and amorphous silica.

2. The heat-sensitive recording material according to claim 1, wherein the water-soluble polymer is at least one selected from polyvinyl alcohol, oxidized starch and urea phosphated starch.

3. The heat-sensitive recording material according to claim 2, wherein the water-soluble polymer contains polyvinyl alcohol (x) and oxidized starch and/or urea phosphated starch (y) at a mass ratio (x/y) of 90/10 to 10/90.

4. The heat-sensitive recording material according to claim 1, wherein the water-soluble polymer contains polyvinyl alcohol (x) and oxidized starch and/or urea phosphated starch (y) at a mass ratio (x/y) of 90/10 to 10/90.

5. The heat-sensitive recording material according to claim 1, wherein the protective layer contains as the inorganic pigment aluminum hydroxide having a volume-average particle size of 0.5 to 0.9 μm.

6. The heat-sensitive recording material according to claim 1, wherein the protective layer contains amorphous silica as the inorganic pigment.

7. The heat-sensitive recording material according to claim 1, wherein the protective layer contains a mordant.

8. The heat-sensitive recording material according to claim 1, wherein the water-soluble polymer is at least one selected from silicon-modified polyvinyl alcohol, diacetone-modified polyvinyl alcohol, acetoacetyl-modified polyvinyl alcohol and amide-modified polyvinyl alcohol.

9. The heat-sensitive recording material according to claim 1, wherein the electron-accepting compound is added in an amount of 50 to 400% by mass relative to 100% by mass of the electron-donating colorless dye.

10. The heat-sensitive recording material according to claim 1, wherein the heat-sensitive color-forming layer contains at least one sensitizer selected from the group consisting of 2-benzylnaphthyl ether, ethylene glycol tolyl ether, p-benzylbiphenyl and 1,2-diphenoxymethylbenzene.

11. The heat-sensitive recording material according to claim 1, wherein the heat-sensitive color-forming layer contains an image stabilizer in an amount of 10 to 100 parts by mass relative to 100 parts by mass of the electron-donating colorless dye.

12. A heat-sensitive recording material comprising a support having succesively disposed thereon:

a heat-sensitive color-forming layer containing an electron-donating colorless dye and an electron-accepting compound; and a protective layer;

wherein the heat-sensitive color-forming layer contains at least one selected from 2-anilino-3-methyl-6-di-n-butylaminofluoran, 2-anilino-3-methyl-6-di-n-amylaminofluoran and 2-anilino-3-methyl-6-(N-ethyl-N-p-benzyl)aminofluoran as the electron-donating colorless dye and 4-hydroxybenzenesulfonanilide as the electron-accepting compound, and the protective layer contains an inorganic pigment and a water-soluble polymer.

13. The heat-sensitive recording material according to claim 12, wherein a coating amount of the protective layer after dried is 0.5 to 2.5 g/m$^2$.

14. The heat-sensitive recording material according to claim 12, wherein the electron-accepting compound is added in an amount of 100 to 300 parts by mass relative to 100 parts by mass of the electron-donating colorless dye.

15. The heat-sensitive recording material according to claim 12, wherein the electron-accepting compound has a volume-average particle size of 1.0 μm or less.

16. The heat-sensitive recording material according to claim 12, wherein the heat-sensitive color-forming layer contains at least one sensitizer selected from the group consisting of 2-benzylnaphthyl ether, 1,2-bis(3-methylphenoxy)ethane and 1,2-diphenoxymethylbenzene.

17. The heat-sensitive recording material according to claim 16, wherein the sensitizer is added in an amount of 100 to 300 parts by mass relative to 100 parts by mass of the electron-donating colorless dye.

18. The heat-sensitive recording material according to claim 12, wherein the inorganic pigment is at least one selected from the group consisting of calcium carbonate, barium sulfate, kaolin, amorphous silica and aluminum hydroxide.

19. The heat-sensitive recording material according to claim 18, wherein the inorganic pigment has a volume-average particle size of 0.5 to 0.9 μm.

20. The heat-sensitive recording material according to claim 12, wherein the protective layer contains a mordant.

* * * * *